US006115016A

United States Patent [19]

Yoshihara et al.

[11] Patent Number: 6,115,016

[45] Date of Patent: Sep. 5, 2000

[54] LIQUID CRYSTAL DISPLAYING APPARATUS AND DISPLAYING CONTROL METHOD THEREFOR

[75] Inventors: Toshiaki Yoshihara; Akihiro Mochizuki; Hironori Shiroto; Tetsuya Makino; Yoshinori Kiyota, all of Kawasaki, Japan

[73] Assignee: Fujitsu Limited, Kawasaki, Japan

[21] Appl. No.: 09/000,749

[22] Filed: Dec. 30, 1997

[30] Foreign Application Priority Data

Jul. 30, 1997 [JP] Japan ..... 9-205073

[51] Int. Cl.[7] ..... G09G 3/36; G09G 5/10; G09G 5/02; G09G 5/04

[52] U.S. Cl. ..... 345/88; 345/102; 345/150; 345/152; 345/148

[58] Field of Search ..... 345/88, 89, 102, 345/154, 152, 147, 148, 83, 150

[56] References Cited

U.S. PATENT DOCUMENTS

| | | | |
|---|---|---|---|
| 4,892,391 | 1/1990 | Stewart et al. | 345/152 |
| 4,907,862 | 3/1990 | Suntola | 350/345 |
| 4,924,215 | 5/1990 | Nelson | 340/701 |
| 5,122,791 | 6/1992 | Gibbons et al. | 340/784 |
| 5,724,062 | 3/1998 | Hunter | 345/102 |
| 5,767,837 | 6/1998 | Hara | 345/152 |
| 5,796,378 | 8/1998 | Yoshida et al. | 345/88 |

FOREIGN PATENT DOCUMENTS 7281150 10/1995 Japan .

*Primary Examiner*—Richard A. Hjerpe
*Assistant Examiner*—Duc Dinh
*Attorney, Agent, or Firm*—Greer, Burns & Crain, Ltd.

[57] ABSTRACT

A display control method of a liquid crystal displaying apparatus for driving a liquid crystal panel comprising two substrates, and a liquid crystal layer therebetween. The driving means includes: pixel electrodes each corresponding to a pixel; and for time-division, emitting an LED (Light Emitting Diode) array for red, green, and blue as a back light within each display period, in synchronization with the on/off operation of the pixel electrodes. Each display period is divided into four. The LEDs in the LED array emit red, green, and blue lights in one of the divided periods. Then, one of the three colors is emitted again. This method solves the problem of the conventional control method for performing time-division color display in a liquid crystal displaying apparatus; namely, the insufficient emission intensity of LEDs makes the intensity of the entire liquid display apparatus insufficient, such that white is seen as somewhat grayish white to the human eye.

17 Claims, 6 Drawing Sheets

LIQUID CRYSTAL DISPLAYING APPARATUS AND DISPLAYING CONTROL METHOD THEREFOR

BACKGROUND OF THE INVENTION

The present invention relates to a liquid crystal displaying apparatus and a displaying control method therefor, and more specifically to a color light source-type liquid crystal displaying apparatus which performs full-color display by time-division emitting a back light for the three primary colors, and the displaying control method therefor.

BRIEF SUMMARY OF THE INVENTION

Along with the recent development of so-called office automation, office automation equipment such as word processors and personal computers has been widely used. Such popularity of office automation equipment in the office has caused demands for portable office automation equipment which can be used both inside and outside the office, requiring minimization of the size of the portable equipment. As one of the means to achieve this object, liquid crystal displaying apparatuses are widely used. The liquid crystal displaying apparatuses involve an essential technique not only for minimizing the size of the battery-driven portable office automation equipment, but also for reducing power consumption.

The liquid crystal displaying apparatuses can be classified into reflection type and transmission type. In the reflection type, a light which is incident from the surface of a liquid crystal panel is reflected by the bottom surface of the liquid panel so as to use the reflection light to recognize images. In the transmission type, a penetration light emitted from a light source (back light) provided on the bottom surface of a liquid panel is used to recognize images. The reflection type has been widely used as monochrome (such as black and white) displaying apparatuses such as portable calculators and watches because of their low cost despite of their poor visibility resulting from the reflection light amount changing depending on environmental conditions. However, they are not suitable for such displaying apparatuses as personal computers with multi-color or full-color display. For this reason, the transmission type is generally used as displaying apparatuses such as personal computers with multi-color or full-color display.

In addition, current color liquid crystal displaying apparatuses are generally classified into STN (Super Twisted Nematic) type and TFT-TN (Thin Film Transistor-Twisted Nematic) type from the viewpoint of liquid crystal materials used. The STN type has a comparatively low production cost, but is not suitable for the display of motion pictures because cross talk is easily generated and the response rate is comparatively slow. In contrast, the TFT-TN type has a better display quality than the STN type, but requires a back light with high intensity because the present transmissivity of the liquid crystal panel is only 4% or so. This increases the power consumption, making the TFT-TN type unsuitable for the portable type with a battery power source. The TFT-TN type has other problems including low response rate particularly in gray scale, narrow viewing angle, and difficult color balance adjustment.

Conventional transmission type liquid crystal displaying apparatuses are generally color-filter type according to which multi-color or full-color display is performed by making a color filter having the three primary colors selectively transparent to a white light by using a back light for white light. However, in such a color filter type, pixels are displayed by using the range of adjacent three-color filters as one unit, which decreases the actual resolution to 1/3.

From these viewpoints, color light source is considered which prevents a decrease in the actual resolution by using a ferroelectric liquid crystal element or antiferroelectric liquid crystal element having a high-rate response against the impressed electric field as a liquid crystal element, so as to time-division emit the same pixel with the three primary colors.

The features of the ferroelectric liquid crystal element or the antiferroelectric liquid crystal element include high-rate response of several hundred to several $\mu$ seconds order, and extremely wide viewing angle due to the liquid crystal molecules being constantly parallel to a substrate (glass substrate) regardless of the presence or absence of impressed voltage. When light emitting diodes (LEDs) are used as the light source for the three primary colors, and the red, green, and blue lights are time-division emitted from the LEDs, the color balance can be changed by controlling the current which flows to the LEDs.

FIG. 1 shows an example of the entire structure of a liquid crystal displaying apparatus which performs a conventional time-division color display. Such a liquid crystal displaying apparatus is disclosed, for example, in Japanese Patent Application Laid-Open No. 7-281150 (1995).

In FIG. 1, a polarizing film 1, a glass substrate 2, a common electrode 3, a glass substrate 4, a polarizing film 5, a light guiding plate+light diffusion plate 6 are laminated in this order from top to bottom. Pixel electrodes 40 which correspond to the display pixels (liquid crystal cells) arranged in the form of a matrix are provided on the surface of the glass substrate 4 on the side of the common electrode 3. The on/off operation of each of the pixel electrodes 40 is controlled by the TFT (Thin Film Transistors) 41, and each of the TFT 41 is driven positively by the liquid crystal driving circuit 8 selectively controlling the on/off operation of a scanning line 42 and a signal line 43. There are unillustrated orientation films which are formed on the pixel electrodes 40 provided on the glass substrate 4, and under the common electrode 3, so as to apply liquid crystal material between these films.

The polarizing film 1, the glass substrate 2, the common electrode 3, the glass substrate 4, and the polarizing film 5 are substantially of the same size, and an LED array 7 is provided in such a manner as to protrude from one side of the light guiding plate+light diffusion plate 6 which is disposed under these components. The light guiding plate+light diffusion plate 6 and the LED array 7 compose a back light. FIG. 2 shows an example of the structure of the LED array 7. The LED array 7 includes LEDs which emit the three primary colors: red, green, and blue on the surface facing the light guiding plate+light diffusion plate 6 and which are arranged serially and repeatedly. The emission of the LEDs for red, green, and blue lights is time-division driven for each color under the control of the light selecting control circuit 9. The light guiding plate+light diffusion plate 6 diffuses the light emitted from each LED of the LED array 7 to the entire surface thereof so as to guide the light.

FIG. 3 shows a time chart illustrating the conventional displaying control method of a liquid crystal displaying apparatus. The conventional displaying control method of the liquid crystal displaying apparatus shown in FIG. 1 will be described as follows with reference to FIG. 3.

FIG. 3(*a*) shows the emission timing of each LED of the LED array 7. In this example, red, green, and blue lights are emitted (put in the "on" state) serially in this order during a sub-frame (sub-period) having (1/180 seconds=about 5.55 ms) which corresponds to 1/3 of one frame period (1/60 seconds about 16.6 ms), which corresponds to one display period of images. In the case of white display, for example, as shown in FIG. 3 (b), by putting the liquid crystal element in the "on" state during all the sub-frame periods in one frame period, red, green, and blue are serially displayed in about 16.6 ms, which is recognized as white color to the human eye. Although it is not illustrated, writing and deleting of data to each pixel of the liquid crystal display element is also performed in each sub-frame, so that red, green, and blue are displayed during a period remaining after the writing and deleting. More specifically, each display is performed during the remainder of a time duration calculated by subtracting time required for the writing and deleting from about 5.5 ms of a sub-frame period.

When red display is performed, as shown in FIG. 3(*c*), the liquid crystal element is put in the "on" state only in the first sub-frame so that red is displayed only during the first sub-frame in a frame of about 16.6 ms, which is seen as red color to the human eye. When green display is performed, as shown in FIG. 3(*d*), the liquid crystal element is put in the "on" state only in the second sub-frame so that green is displayed only during the second sub-frame in a frame of about 16.6 ms, which is seen as green color to the human eye. When blue display is performed, as shown in FIG. 3(*e*), the liquid crystal element is put in the "on" state only in the third sub-frame so that blue is displayed only during the third sub-frame in a frame of about 16.6 ms, which is seen as blue color to the human eye.

In the case of an intermediate color display, such as yellow, as shown in FIG. 3(*f*), the liquid crystal element is put in the "on" state both in the first sub-frame for red and the second sub-frame for green so that red and green are respectively displayed during the first and second sub-frames in a frame of about 16.6 ms, which is seen as yellow color to the human eye. In the case of magenta display, as shown in FIG. 3(*g*), the liquid crystal element is put in the "on" state both in the first sub-frame for red and the third sub-frame for blue so that red and blue are respectively displayed during the first and third sub-frames in a frame of about 16.6 ms, which is seen as magenta color to the human eye. In the case of cyan display, as shown in FIG. 3(*h*), the liquid crystal element is put in the "on" state both in the second sub-frame for green and the third sub-frame for blue so that green and blue are respectively displayed during the second and third sub-frames in a frame of about 16.6 ms, which is seen as cyan color to the human eye.

Gray scale can be displayed by controlling the intensities of two or three colors of red, green, and blue. To be more specific, the light amount of each color in the LED array 7 can be adjusted by means of a liquid crystal panel.

The conventional control method of performing a time-division color display in the liquid crystal displaying apparatus having the above-mentioned construction has a drawback that the intensity as the entire liquid crystal displaying apparatus is insufficient because of the poor emission intensity of LEDs as the back light so that white is recognized as grayish white to the human eye.

The present invention, which has been achieved in view of these circumstances, has an object of providing a liquid crystal displaying apparatus which includes a back light for performing time-division color display and which can display with sufficient intensity especially in white display, and also providing the displaying control method therefor.

The displaying control method of a liquid crystal displaying apparatus according to the present invention drives an on/off operation of each switching element corresponding to each element in a liquid crystal panel in accordance with data on red, green, and blue of each element within each display period, and time-division emits red, green, and blue lights of a back light in each display period in synchronization with the on/off operation of each switching element. This displaying control method is characterized in that each display period is divided into at least four sub-periods, and red, green, and blue lights of the back light are emitted in one of a first to third sub-periods, respectively, and at least one of red, green, and blue lights is emitted again in a fourth sub-period, and each switching element is driven on/off in response to the data on red, green, and blue in the first to third sub-periods, and each switching element is driven on/off in response to the data on at least one of red, green, and blue in the fourth sub-frame.

According to the above-mentioned method of the present invention, each display period is divided into at least four sub-periods, and after a back light for red, green, and blue is emitted once for each color in the first to third sub-periods, at least one of the colors is again emitted in the fourth sub-period. Each switching element is driven on and off in response to the data on red, green, or blue in the first to third sub-periods, and each switching element is driven on and off in response to the data on either one of red, green, and blue in the fourth sub-period. The additional emission in the fourth sub-period improves the entire intensity.

The displaying control method of a liquid crystal displaying apparatus of the present invention is characterized in that all, two or one of red, green, and blue lights of the back light are emitted at the same time in the fourth sub-period, and each switching element is driven on/off in response to the data all, two, or one of on red, green, and blue.

In the above-mentioned method of the present invention, after the red, green, and blue are emitted once for each in the first to third sub-periods, all, two, or one of the colors are emitted at the same time in the fourth sub-period. Also, each switching element is driven on and off in response to the data on all, two, or one of red, green, and blue, so that the entire intensity can be improved by selecting a desired measure as the occasion demands.

The displaying control method of a liquid crystal displaying apparatus of the present invention, in the above-mentioned method, each display period is 1/60 seconds or shorter, and each sub-period is 1/240 seconds or shorter.

In the above-mentioned method of the present invention, the emission of the back light for all the colors is completed within the period of 1/240 seconds or less into which the display period of 1/60 seconds or less is divided.

The liquid crystal displaying apparatus of the present invention is characterized by comprising: a liquid crystal panel provided with a plurality of liquid crystal elements and a plurality of switching elements corresponding to the plurality of liquid crystal elements; a back light which is provided on a back surface of the liquid crystal panel, and emits red, green, and blue lights; a liquid crystal driving means for dividing one display period of the liquid crystal panel into at least four sub-periods, time-division driving an on/off operation of the switching elements in accordance with data on red, green, and blue of each element in first to third sub-periods, and driving on/off operation of each switching elements in response to the data on at least one of red, green, and blue lights in a fourth sub-period; and a back light controlling means for making the back light emit the red, green, and blue lights in one of the first to third sub-periods in synchronization with the on/off operation of the switching elements by the liquid crystal driving means, and making the back light emit at least one of the red, green, and blue lights again in the fourth sub-period.

In the above-mentioned apparatus of the present invention, the back light controlling means divides each display period at least into four sub-periods, and after the red, green, and blue are emitted for one time each in the first to third sub-periods, at least one of the colors is again emitted in the fourth sub-period. The liquid crystal driving means turns on and off each switching element in response to the data of red, green, or blue in the first to third sub-periods, and turns on and off each switching element in response to the data of at least one of red, green, and blue in the fourth sub-period. The additional emission in the fourth sub-period improves the entire intensity.

The liquid crystal displaying apparatus of the present invention, in the above-mentioned apparatus, is characterized in that the back light controlling means makes all of the red, green, and blue back lights emit at the same time in the fourth sub-period, and the liquid crystal driving means drives on/off each of the switching elements in response to all the data on red, green, and blue lights in the fourth sub-period.

In the above-mentioned apparatus of the present invention, after the back light for red, green, and blue is emitted once for each color in the first to third sub-periods, all of the colors are again emitted at the same time in the fourth sub-period, and each switching element is driven on and off in response to the data on all of red, green, and blue in the fourth sub-period. As a result, the entire intensity can be improved by selecting a desired measure as the occasion demands.

The liquid crystal displaying apparatus of the present invention, in the above-mentioned apparatus, is also characterized in that each display period is 1/60 seconds or shorter, and each sub-period is 1/240 seconds or shorter.

In the above-mentioned method of the present invention, the emission of the back light for all the colors is completed within the period of 1/240 seconds or less into which the display period of 1/60 seconds or less is divided.

The liquid crystal displaying apparatus of the present invention is also characterized in that back light comprises LEDs for emitting red, green, and blue lights, respectively, diffusion plates for diffusing each light emitted by the LEDs, and a light guiding plate for guiding the light emitted by the LEDs to a surface of the liquid crystal panel.

In the apparatus of the present invention, the back light is composed of LEDs for red, green, and blue, diffusion plates for diffusing the light emitted from the LEDs, and a light guiding plate for guiding the light emitted from the LEDs to a surface of a liquid crystal panel. Consequently, the transparent light from the back light can become uniform.

The liquid crystal displaying apparatus of the present invention is also characterized in that the liquid crystal material of the liquid crystal panel is either ferroelectric liquid crystal material or antiferroelectric liquid crystal material.

In such an apparatus of the present invention, the use of ferroelectric liquid crystal or antiferroelectric liquid crystal as the liquid crystal material enables a high-rate on/off control, thereby sufficiently coping with the emission control of the back light.

The above and further objects and features of the invention will more fully be apparent from the following detailed description with accompanying drawings.

DESCRIPTION OF THE PREFERRED EMBODIMENTS

Figure 4:
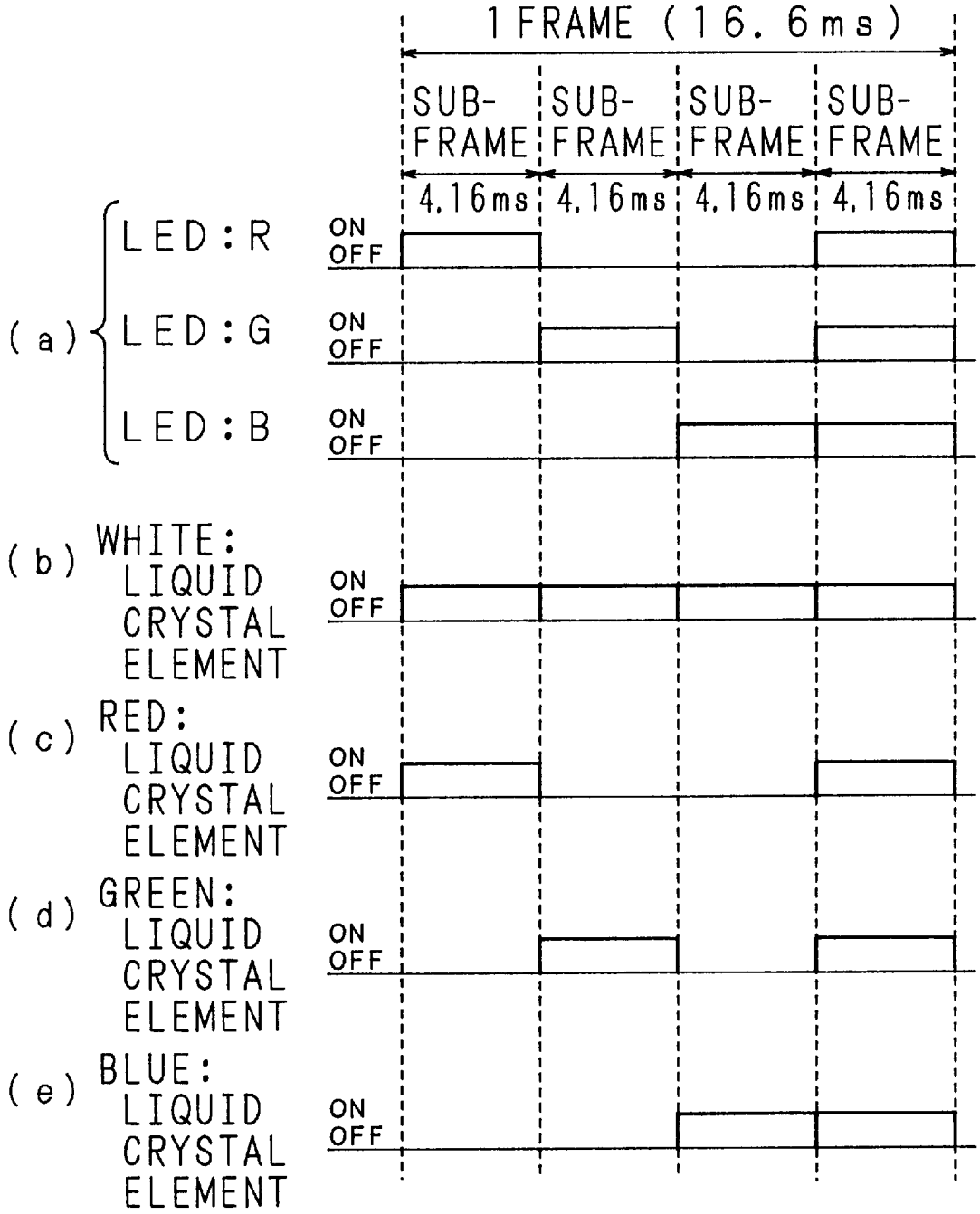
FIG. 4 is a time chart illustrating a displaying control method of a liquid crystal displaying apparatus of the present invention.

The present invention will be detailed based on the drawings which show the embodiments. First of all, the mechanism of the displaying control method of a liquid crystal displaying apparatus according to the present invention will be described. FIG. 4 is a time chart illustrating the displaying control method of a liquid crystal displaying apparatus of the present invention.

In the above-mentioned prior art, the LEDs in the LED array 7 serially emit red, green, and blue in the three sub-frames (hereinafter referred to as sub-periods), respectively, into which a frame of about 16.6 ms is divided. In contrast, in the displaying control method of a liquid crystal displaying apparatus according to the present invention, one frame of about 16.6 ms is divided into four sub-frames (sub-periods), and the LEDs in the LED array 7 are serially emit red, green, and blue in the leading first, second, and third sub-frames, respectively, and either one, two, or all of the colors is emitted in the fourth sub-frame.

To be more specific, as shown in FIG. 4(*a*), one frame of about 16.6 ms is divided into four about 4.16 ms sub-frames, and LEDs emit red, green, and blue in the first, second, and third sub-frames, respectively, and all of the colors: red, green, and blue are emitted in the fourth sub-frame. As shown in FIG. 4(*b*), the liquid crystal displaying element (liquid crystal pixel) is put in the "on" state during the entire sub-frame of this one frame. However, in the fourth sub-frame, as shown in FIG. 4(*a*), any one of red, green, and blue may be emitted instead of all of them, or a combination of two colors (red and blue, red and green, or blue and green) may be emitted.

As shown in FIG. 4(*a*), in the case where the LEDs in the LED array 7 emit red, green, and blue lights in the first, second, and third sub-frames, respectively, and all of the LEDs in the LED array 7 emit the respective colors at the same time in the fourth sub-frame, white is displayed for 1/4 frame in the first to third sub-frames where the LEDs emit red, green, and blue lights serially, and 1/4 frame in the fourth sub-frame where all the LEDs emit the three colors at the same time. Thus, the total displaying time of white corresponds to 2/4 frame. On the other hand, the display time for white in the conventional method is 1/3 frame, which means that the display time for white according to the displaying control method of a liquid crystal displaying apparatus of the present invention is considered to be 6/4 or about 1.5 time as long as that of the conventional method. In other words, according to the displaying control method of a liquid crystal displaying apparatus of the present invention, about 1.5 times as high intensity for white as in the conventional method can be obtained.

When red display is performed according to the displaying control method of a liquid crystal displaying apparatus of the present invention, as shown in FIG. 4(*c*), the liquid crystal element is put in the "on" state in the first sub-frame for red emission and the fourth sub-frame for white emission. As a result, red is displayed in the first sub-frame of about 4.16 ms in one frame of about 16.6 ms and white is displayed in the fourth sub-frame, which is recognized as bright red to the human eye.

When green display is performed according to the displaying control method of a liquid crystal displaying apparatus of the present invention, as shown in FIG. 4(*d*), the liquid crystal element is put in the "on" state in the second sub-frame for green emission and the fourth sub-frame for white emission. As a result, green is displayed in the second sub-frame of about 4.16 ms in one frame of about 16.6 ms and white is displayed in the fourth sub-frame, which is recognized as bright green to the human eye.

When blue display is performed according to the displaying control method of a liquid crystal displaying apparatus of the present invention, as shown in FIG. 4(*e*), the liquid crystal element is put in the "on" state in the third sub-frame for blue emission and the fourth sub-frame for white emission. As a result, blue is displayed in the third sub-frame of about 4.16 ms in one frame of about 16.6 ms and white is displayed in the fourth sub-frame, which is recognized as bright blue to the human eye.

Red, green, and blue can be displayed in high purity by putting the liquid crystal displaying element in the "off" state in the fourth sub-frame.

Figure 1:
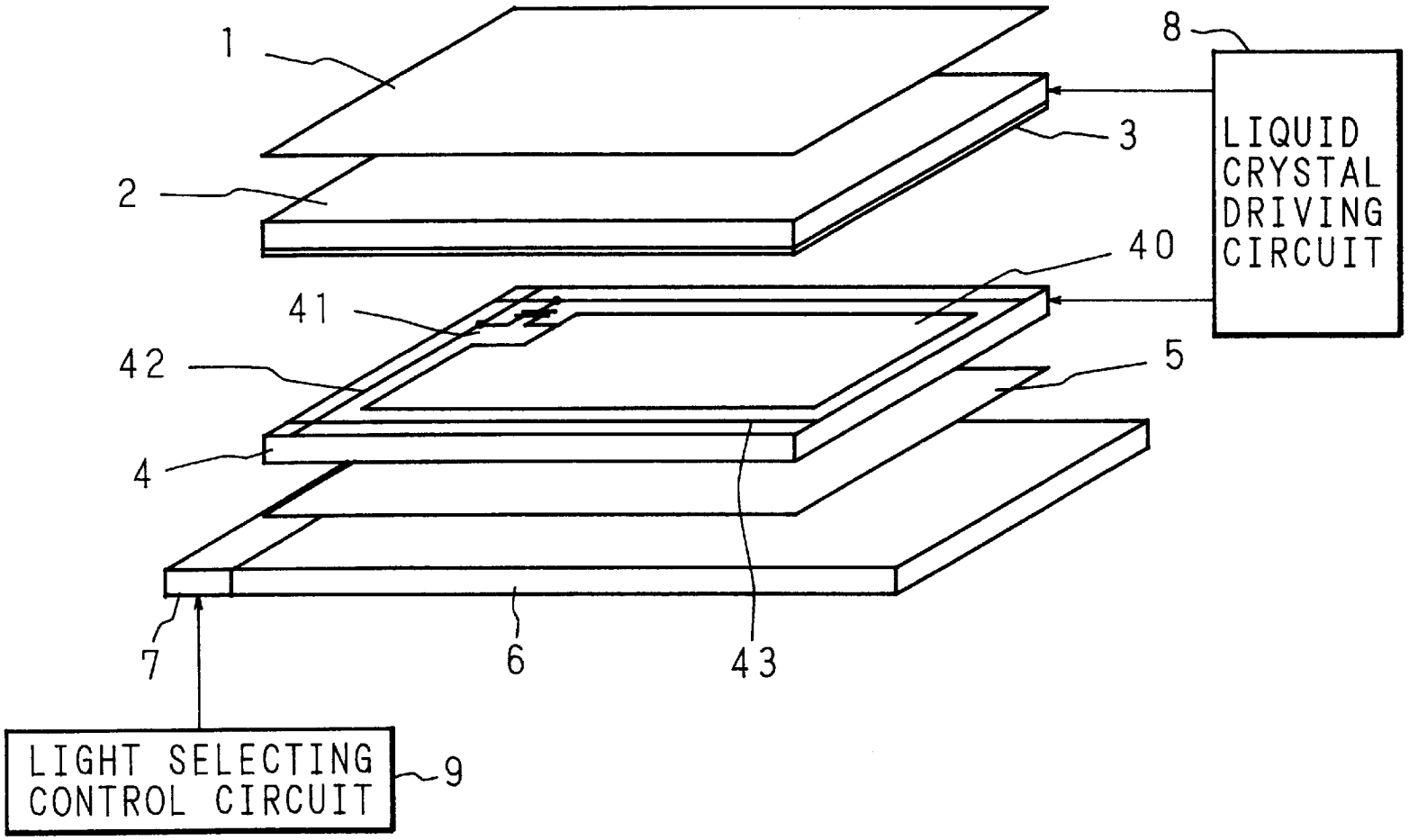
FIG. 1 PRIOR ART
FIG.1 is a block diagram illustrating the entire structure of a liquid crystal displaying apparatus which performs a conventional time-division color display.
Figure 5:
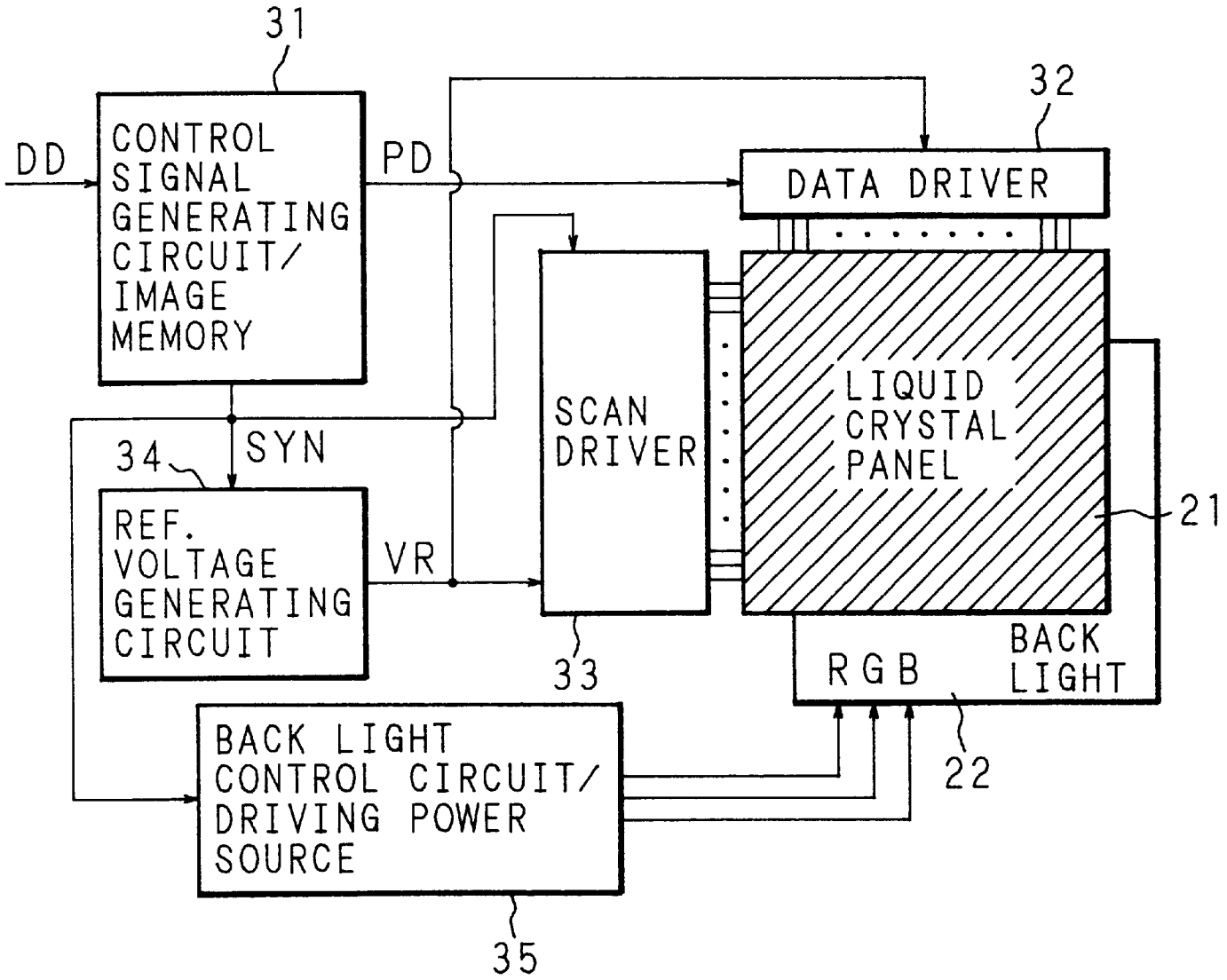
FIG. 5 is a block diagram illustrating the entire liquid crystal displaying apparatus of the present invention.
Figure 6:
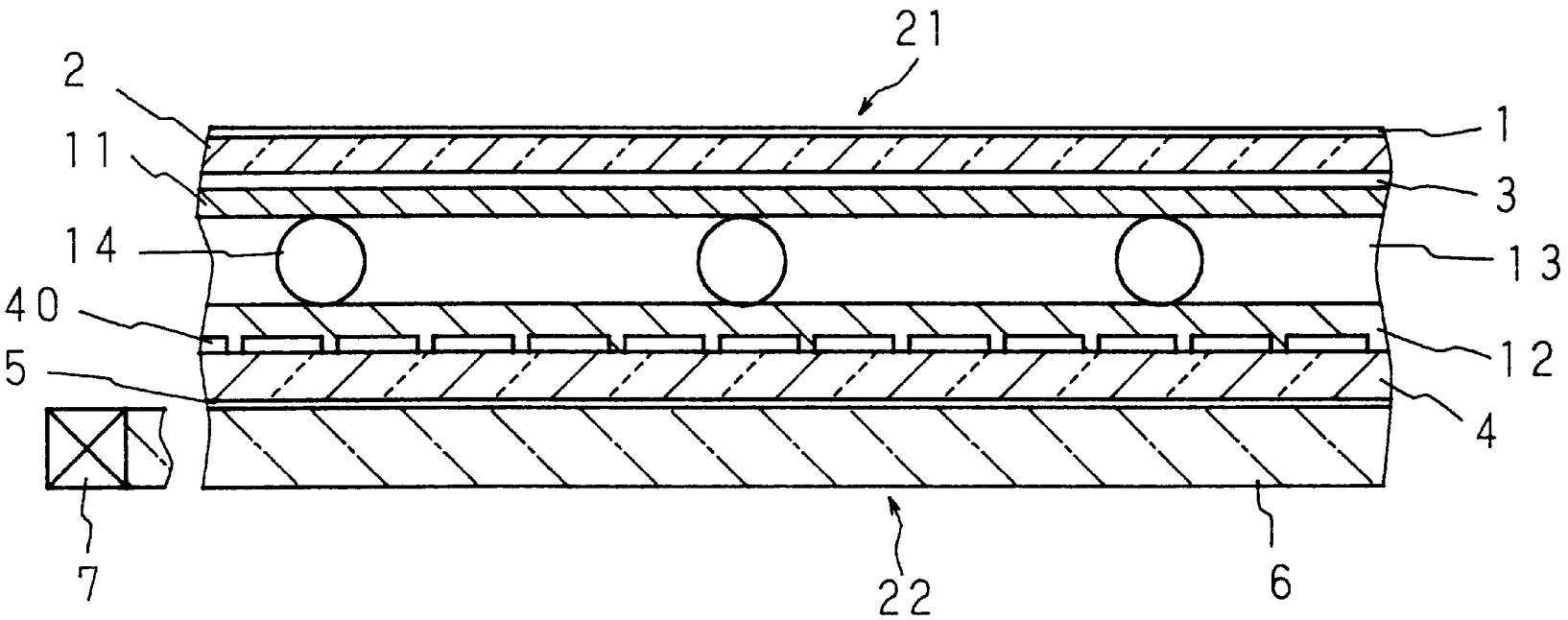
FIG. 6 is a schematic cross section of the liquid crystal panel and the back light used for the liquid crystal displaying apparatus of the present invention.

The displaying control method of a liquid crystal displaying apparatus of the present invention based on the above-mentioned principle will be detailed based on the drawings. FIG. 5 shows a structure of the liquid crystal displaying apparatus of the present invention, and FIG. 6 shows the cross section of the liquid crystal panel. The structures of the liquid crystal panel and the back light are basically the same as those of the prior art shown in FIG. 1.

In FIG. 5, the reference numerals 21 and 22 represent the crystal panel and the back light, respectively, whose cross sectional structures are shown in FIG. 6. As shown in FIG. 6, the back light 22 is composed of the LED array 7 and the light guiding plate+light diffusion plate 6, while the liquid crystal panel 21 as shown in FIG. 6 has a structure between the two polarizing films 1 and 5.

The liquid crystal panel 21, as shown in FIG. 6, is composed of a polarizing film 1, a glass substrate 2, a common electrode 3, a glass substrate 4, a polarizing film 5, and a light guiding plate+light diffusion plate 6 which are laminated in this order from top to bottom. Pixel electrodes 40 which correspond to the display pixels are provided on the surface of the glass substrate 4 on the side of the common electrode 3. The on/off operation of each of the pixel electrodes 40 is controlled by the TFT (Thin Film Transistor) 41 like in the above-mentioned prior art, and each of the TFT 41 is driven by a data driver 32 selectively driving on and off the signal line and also by a scan driver 33 selectively driving on and off the scanning line. Consequently, the intensity of the transparent light of each pixel is controlled by the signal from the signal line.

Orientation films 12 and 11 are positioned on the pixel electrodes 40 provided on the glass substrate 4 and under the common electrode 3, respectively. There is a liquid crystal material applied between these orientation films 12 and 11, so as to form a liquid crystal layer 13. The reference numeral 14 represents a spacer for keeping the liquid crystal layer 13 at an appropriate thickness.

Figure 2:
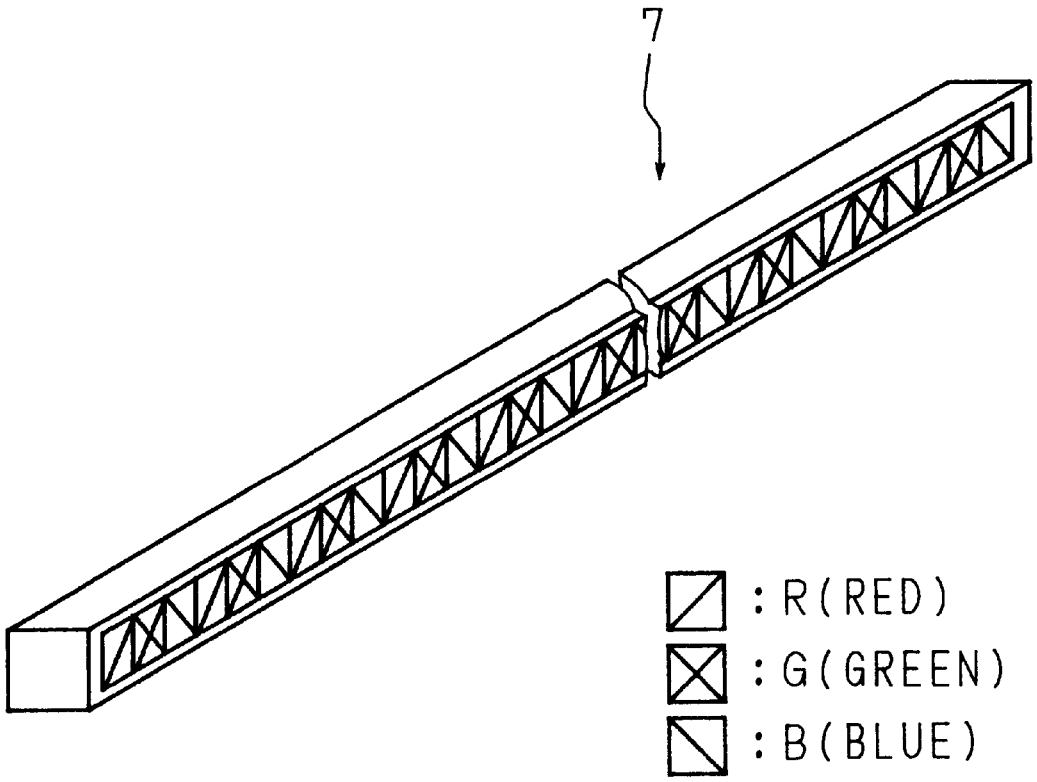
FIG. 2 PRIOR ART
FIG. 2 is a block diagram illustrating an LED array.
Figure 3:
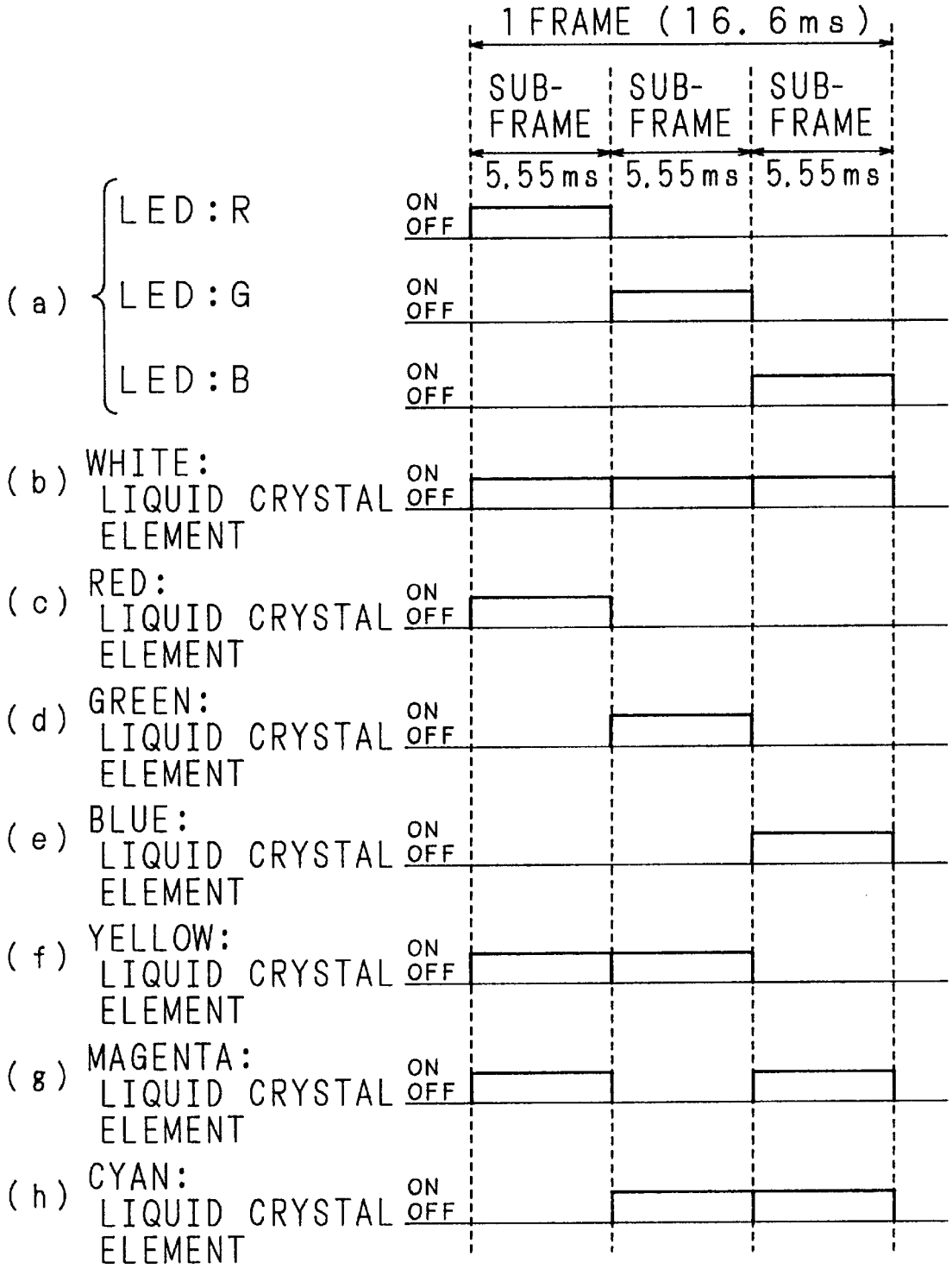
FIG. 3 PRIOR ART
FIG. 3 is a time chart illustrating a conventional displaying control method of a liquid crystal displaying apparatus of prior art.

The back light 22 is positioned under the liquid crystal panel 21, and the LED array 7 is disposed in such a manner as to protrude from one side of the light guiding plate+light diffusion plate 6. The LED array 7, like that of the prior art whose structure is shown in FIG. 2, includes LEDs which serially emit the three primary colors: red, green, and blue repeatedly against the surface facing the light guiding plate+light diffusion plate 6. The light guiding plate+light diffusion plate 6 guides the light emitted from each of the LEDs in the LED array 7 to the entire surface thereof and diffuses to the upper surface.

In FIG. 5, the control signal generating circuit/image memory 31 is given display data DD to be displayed in the liquid crystal panel 21 by a personal computer or another external device. The control signal generating circuit/image memory 31 temporarily stores the display data DD to the image memory and then outputs the data in each pixel unit (hereinafter referred to as pixel data PD) to a data driver 32 in synchronization with a synchronous signal SYN. The data driver 32 controls the on/off operation of the signal lines in the pixel electrodes 40 in accordance with the pixel data PD which are given by the control signal generating circuit/image memory 31.

The control signal generating circuit/image memory 31 outputs a synchronous signal SYN to a scan driver 33, a reference voltage generating circuit 34, and a back light control circuit/driving power source 35.

The scan driver 33 controls the on/off operation of the scanning lines of the pixel electrodes 40 in synchronization with the synchronous signal SYN which is given from the control signal generating circuit/image memory 31. The reference voltage generating circuit 34 generates a reference voltage VR in synchronization with the synchronous signal SYN and gives it to the data driver 32 and the scan driver 33.

The back light control circuit/driving power source 35 gives the driving voltage to the back light 22 in synchronization with the synchronous signal SYN which is given by the control signal generating circuit/image memory 31 so as to make the LED array 7 of the back light 22 emit light.

According to the liquid crystal displaying apparatus of the present invention, the control shown in the time chart of FIG. 4 is performed. To be more specific, as shown in FIG. 4(*a*), the back light control circuit/driving power source 35 so controls that the LEDs emit red, green, and blue lights during the first, second, and third sub-frames, respectively and further emit all these colors in the fourth sub-frame in synchronization with the synchronous signal SYN.

In the case where the pixel data PD given by the control signal generating circuit/image memory 31 to the data driver 32 is on white, as shown in FIG. 4(*b*), the data driver 32 and the scan driver 33 control the liquid crystal of the pixel electrodes 40 through the corresponding TFTs so as to put in the "on" state during the entire sub-frame in period of one frame. In the case where the pixel data PD is on red, as shown in FIG. 4(*c*), the data driver 32 and the scan driver 33 control the liquid crystal of the pixel electrodes 40 through the corresponding TFTs so as to put in the "on" state in the first and fourth sub-frames in one frame. In the case where the pixel data PD is on green, as shown in FIG. 4(*d*), the data driver 32 and the scan driver 33 control the liquid crystal of the pixel electrodes 40 through the corresponding TFTs so as to put in the "on" state in the second and fourth sub-frames in one frame. In the case where the pixel data PD is on blue, as shown in FIG. 4(*e*), the data driver 32 and the scan driver 33 control the liquid crystal of the pixel electrodes 40 through the corresponding TFTs so as to put in the "on" state in the third and fourth sub-frames in one frame.

As a result of the above-mentioned emission control of the back light 22 by the back light control circuit/driving power source 35, and the on/off operation of the liquid crystal of each of the pixel electrodes 40 of the liquid crystal panel 21 by the data driver 32 and the scan driver 33, the above-mentioned displaying control method of a liquid crystal displaying apparatus of the present invention can be realized by the liquid crystal displaying apparatus of the present invention shown in FIG. 5.

The specific embodiments of the liquid crystal displaying apparatus and the displaying control method therefor according to the present invention will be described as follows.

First of all, each component of the liquid crystal panel 21 whose cross section is shown in FIG. 6 was produced as follows. Each of the pixel electrodes 40 was a matrix of 0.31 mm×0.31 mm square with a pitch of 0.33 mm, and the number of pixels was 1024×768. After having been cleaned, the TFT substrate and the common electrode 3 were coated with polyimide with a spin coater and burned for one hour at 200° C., so as to produce polyimide films of about 200 Å as the orientation films 11 and 12. These orientation films 11 and 12 were rubbed with rayon cloth and combined with a silica spacer 14 whose average particle diameter was 1.6 $\mu$m disposed therebetween to fill up the gap, so as to form an empty panel. A dielectric liquid crystal whose main component was naphthalene liquid crystal was applied between the orientation films 11 and 12 so as to form a liquid crystal layer 13. Finally, the two polarizing films (Nitto Denko Corporation: NPF-EG1225DU) 1 and 5 in the state of crossed Nicols were combined so as to make a dark condition when the ferroelectric liquid crystal molecules were declined to one side. Then, this liquid crystal panel 21 was mounted on the back light 22, in other words, the light guiding plate+light diffusion plate 6.

In the construction of mounting the liquid crystal panel 21 on the back light 22 composed of the LED array 7 and the light guiding plate+light diffusion plate 6, the intensity of each display color was examined both in the conventional method according to which the LEDs of the LED array 7 serially emitted red, green, and blue lights in the three sub-frames into which the frame of about 16.6 ms was divided, and the displaying control method of a liquid crystal displaying apparatus of the present invention according to which the LEDs of the LED array 7 serially emitted red, green, and blue lights in the first to third sub-frames, respectively, and all the LEDs emitted the three colors at the same time in the final fourth sub-frame. The results are shown in Table 1.

TABLE 1

| | (unit: cd/m$^2$) | |
|---|---|---|
| | R, B, G and W emission (present invention) | R, B and G emission (prior art) |
| White display | 62.7 | 42.4 |
| Red display | 42.7 | 15.4 |
| Green display | 52.4 | 28.2 |

TABLE 1-continued

| | (unit: cd/m$^2$) | |
|---|---|---|
| | R, B, G and W emission (present invention) | R, B and G emission (prior art) |
| Blue display | 36.7 | 9.19 |
| Black display | 5.92 | 4.39 |

In the displaying control method of a liquid displaying apparatus of the present invention which uses the back light for red, green, blue, and white emission, the largest intensity of white display, which has been a conventional problem, is 62.7 cd/m$^2$ that is about 1.5 times as high as 42.4 cd/m$^2$ of the conventional method which uses the back light for red, green, and blue emission. These results prove the predicted results of the above-described principle. The intensity for white display: 62.7 cd/m$^2$ according to the displaying control method of a liquid displaying apparatus of the present invention corresponds to that of the liquid crystal displaying apparatus which is generally used in portable personal computers, or so-called notebook personal computers and can be clearly recognized as white to the human eye. On the other hand, the intensity of white display: 42.4 cd/m$^2$ according to the conventional method was recognized as grayish white.

The present invention showed higher peak intensities for the other display colors, that is, red, green, and blue than those in the conventional method. The intensity of black display was a little higher than that of the conventional method, but it was sufficiently recognizable as black, not gray.

As described hereinbefore, in the displaying control method of a liquid displaying apparatus of the present invention, it becomes possible to improve the intensity of white display, which has been a conventional problem, without changing the intensity of the back light itself. Furthermore, since the intensity improvement is carried out by using the light emission sequence of sub-frames, white display can be obtained in the combination of the first to third sub-frames and the fourth sub-frame in the above-mentioned embodiment. Because these two light intensities can be adjusted separately, the number of gradations can be easily increased.

In the above-mentioned embodiment, ferroelectric liquid crystal material is used as the liquid crystal layer 13; however, the same effects can be obtained by using antiferroelectric liquid crystal material. Although one frame is divided into four sub-frames in the above-mentioned embodiment, it goes without saying that each frame may be divided into more sub-frames. After the emission of red, green, and blue is conducted first, all of the three colors, two of them, or one of them may be emitted in combination. Such combinations can be adopted according to the various situations. For example, when the intensity of white display is low, all the colors can be emitted again. When the intensity of red display is low, red can be emitted again. When the color tone of the back light is desired to move towards blue-green, blue and green may be emitted again. When there is any special intention concerning intensity display, appropriate combination can be adopted suitable for the case.

In the above-mentioned embodiment, the LED array is used as back light; however, an LED may be used for each of red, green, and blue individually, or another light source may be used instead.

As described hereinbefore, in the displaying control method of a liquid displaying apparatus of the present invention, each display period is divided into at least four sub-periods (sub-frames), and a back light for red, green, and blue is emitted once for each color in the first to third sub-periods, and then at least one of the colors is emitted again in the fourth sub-frame. As a result, it becomes possible to improve display intensity without increasing the intensity of the back light itself, in other words, without substantially increasing the power consumption.

According to the liquid displaying apparatus and the displaying control method therefor of the present invention, after the back light for red, green, and blue is emitted once for each color, all of the colors, two of them, or one of them is emitted again in the fourth sub-frame. Thus, display quality can be improved by selecting an appropriate means.

According to the liquid displaying apparatus and the displaying control method therefor of the present invention, the emission of the back light for these colors is completed within the time period corresponding to 1/4 of the display period which is shorter than 1/60 seconds, so that it can be realized with the conventional display period.

According to the liquid displaying apparatus of the present invention, the back light is composed of LEDs for red, green, and blue, diffusion plates for diffusing light emitted by each LED, and a light guiding plate which guides the light emitted by the LED to a surface of the liquid crystal panel. As a result, uniform transparent light can be obtained.

According to the liquid displaying apparatus of the present invention, liquid crystal material is either ferroelectric liquid crystal material or antiferroelectric liquid crystal material, which realizes high-rate on/off operation, and motion picture display, in addition to the advantage of fully responding to the emission control of the back light.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A displaying control method of a liquid crystal displaying apparatus comprising the steps of:

driving on/off operation of each switching element corresponding to each element in a liquid crystal panel in accordance with data on red, green, and blue of said each element within each display period; and time-division emitting red, green, and blue lights of a back light in each display period in synchronization with the on/off operation of said each switching element, including the steps of dividing each said display period into only four sub-periods defining consecutive periods from a first period to a fourth period, and emitting one of red, green, and blue lights of said back light in one of said first to third sub-periods, respectively, and at least one of red, green, and blue lights is emitted again in a fourth sub-period;

said driving on/off operation including driving each said switching element on/off in response to the data on red, green, and blue in the first to third sub-periods, and driving each said switching element on/off in response to the data on at least one of red, green, and blue in the fourth sub-period.

2. The displaying control method of a liquid crystal displaying apparatus as set forth in claim 1, wherein said each display period is 1/60 seconds or shorter, and said each sub-period is 1/240 seconds or shorter.

3. The displaying control method of a liquid crystal displaying apparatus as set forth in claim 1, wherein all of red, green, and blue lights of said back light are emitted in the fourth sub-period, and said each switching element is driven on/off in response to all the data on red, green, and blue.

4. The displaying control method of a liquid crystal displaying apparatus as set forth in claim 3, wherein said each display period is 1/60 seconds or shorter, and said each sub-period is 1/240 seconds or shorter.

5. The displaying control method of a liquid crystal displaying apparatus as set forth in claim 1, wherein said step of emitting at least one light during said fourth sub-period further includes simultaneously emitting two of red, green, and blue lights of said back light in the fourth sub-period, and said step of driving each said switching element further includes driving each said switching element on/off in response to the data on the two of red, green, and blue lights, wherein at least one said switching element was driven to turn on during said first to said third sub-periods in response to a light emitted during said first to third periods with the same color as the color of at least one light of said two of said red, green, and blue lights emitted in said fourth sub-period.

6. The displaying control method of a liquid crystal displaying apparatus as set forth in claim 5, wherein said each display period is 1/60 seconds or shorter, and said each sub-period is 1/240 seconds or shorter.

7. The displaying control method of a liquid crystal displaying apparatus as set forth in claim 1, wherein said step of emitting at least one light during said fourth sub-period further includes emitting only one of red, green, and blue lights of the back light in the fourth sub-period, and said step of driving each said switching element further includes driving each said switching element on/off in response to the data on one of red, green, and blue lights, wherein at least one said switching element was driven to turn on during said first to said third sub-periods in response to a light emitted during said first to third periods with the same color as the color of said one light of said red, green, and blue lights emitted in said fourth sub-period.

8. The displaying control method of a liquid crystal displaying apparatus as set forth in claim 7, wherein said each display period is 1/60 seconds or shorter, and said each sub-period is 1/240 seconds or shorter.

9. A liquid crystal displaying apparatus comprising:

a liquid crystal panel provided with a plurality of liquid crystal elements and a plurality of switching elements corresponding to the plurality of liquid crystal elements;

a back light which is provided on a back surface of said liquid crystal panel, and emits red, green, and blue light;

a liquid crystal driving means for dividing one display period of said liquid crystal panel into only four sub-periods defining first to fourth sub-periods, time-division driving an on/off operation of said switching elements in accordance with data on red, green, and blue of each element in said first to third sub-periods, and driving on/off operation of said each switching elements in response to the data on at least one of red, green, and blue lights in a fourth sub-period; and a back light controlling means for making said back light emit the red, green, and blue lights in one of the first to third sub-periods in synchronization with the on/off operation of said switching elements by said liquid crystal driving means, and making said back light emit at least one of the red, green, and blue lights again in the fourth sub-period.

10. The liquid crystal displaying apparatus as set forth in claim 9, wherein said each display period is 1/60 seconds or shorter, and said each sub-period is 1/240 seconds or shorter.

11. The liquid crystal displaying apparatus as set forth in claim 9, wherein said back light comprises LEDs for emitting red, green, and blue lights, respectively, diffusion plates for diffusing each light emitted by said LEDs, and a light guiding plate for guiding the light emitted by said LEDs to a surface of said liquid crystal panel.

12. The liquid crystal displaying apparatus as set forth in claim 9, wherein liquid crystal material of said liquid crystal panel is either ferroelectric liquid crystal material or anti-ferroelectric liquid crystal material.

13. The liquid crystal displaying apparatus as set forth in claim 9, wherein said back light controlling means makes all of the red, green, and blue lights emit in the fourth sub-period, and said liquid crystal driving means drives on/off each of said switching elements in response to all the data on red, green, and blue lights in the fourth sub-period.

14. The liquid crystal displaying apparatus as set forth in claim 13, wherein said each display period is 1/60 seconds or shorter, and said each sub-period is 1/240 seconds or shorter.

15. The displaying control method of a liquid crystal displaying apparatus as set forth in claim 1, wherein said step of emitting at least one light during said fourth sub-period further includes simultaneously emitting two of red, green, and blue lights of said back light in the fourth sub-period, and said step of driving each said switching element further includes driving each said switching element on/off in response to the data on the two of red, green, and blue lights, wherein at least one said switching element was driven to turn on during said first to said third sub-periods in response to a light emitted during said first to said third periods with a different color as the colors of said two of said red, green, and blue lights emitted in said fourth sub-period.

16. The displaying control method of a liquid crystal displaying apparatus as set forth in claim 1, wherein said step of emitting at least one light during said fourth sub-period further includes emitting only one of red, green, and blue lights of the back light in the fourth sub-period, and said step of driving each said switching element further includes driving each said switching element on/off in response to the data on one of red, green, and blue lights, wherein at least one said switching element was driven to turn on during said first to said third sub-periods in response to a light emitted during said first to third periods with a different color as the color of said one light of said red, green, and blue lights emitted in said fourth sub-period.

17. The displaying control method of a liquid crystal displaying apparatus as set forth in claim 11, wherein said LEDs are arranged in a single row along one outer edge of said light guiding plate.

* * * * *